United States Patent [19]

Flor

[11] Patent Number: 5,037,084

[45] Date of Patent: Aug. 6, 1991

[54] ADJUSTABLE EXERCISING STEP

[76] Inventor: Robert J. Flor, 3002 N. Kimberley Ct., Atlanta, Ga. 30340

[21] Appl. No.: 535,831

[22] Filed: Jun. 11, 1990

[51] Int. Cl.[5] ..... A63B 22/00; A47B 9/00; A47C 3/20; A47C 16/02

[52] U.S. Cl. ..... 272/70; 272/144; 108/12; 108/144; 297/345; 297/439

[58] Field of Search ..... 272/70, 144; 297/438, 297/439, 461, 345; 108/12, 19, 59, 91, 106, 107, 110, 144, 92, 96; 211/175, 207, 208; 248/157, 161, 407, 423

[56] References Cited

U.S. PATENT DOCUMENTS

| | | | |
|---|---|---|---|
| 314,831 | 3/1885 | Hardy | 108/144 |
| 3,586,306 | 6/1971 | Reece et al. | 248/161 |
| 4,549,767 | 10/1985 | Hampshire et al. | 297/439 |
| 4,624,341 | 11/1986 | Lee | 108/144 |
| 4,950,033 | 8/1990 | Anderson | 297/439 |

*Primary Examiner*—Richard J. Apley
*Assistant Examiner*—Karen G. Horowitz
*Attorney, Agent, or Firm*—James B. Middleton

[57] ABSTRACT

A step for performing exercises is circular to allow approaches from any direction equally. The step has a base member and a platform member, the platform member being selectively movable with respect to the base. The base has a plurality of grooves, and the platform has a plurality of tongues to be received in the grooves. There are grooves of different depths so that, by selecting the proper grooves for the tongues, the height of the platform can be changed. An elastic may hold the base and platform together while allowing adjustment.

7 Claims, 1 Drawing Sheet

ADJUSTABLE EXERCISING STEP

INFORMATION DISCLOSURE STATEMENT

It has long been recognized that the activity of walking up and down steps is a reasonably strenuous exercise. With this knowledge, there are many controlled exercises in which a person steps up one or two steps, and then steps down the same number. The use of the step has recently been incorporated into aerobic exercise programs.

A major difficulty in attempting to use this stepping activity as a controlled exercise is that one rarely has steps appropriately available for the exercise. One person may be able to manage at home, but naturally occurring steps are rarely available for a class exercise. There has been some use of stadium bleachers, but these are not variable to conform to the desired level of activity, and some bleachers can be hazardous for such use. To overcome these difficulties, the prior art includes some steps, or benches, designed for use in exercising. One of these prior art devices is a step in usual form, but foldable so it can be stored when not in use. This device is disclosed in U.S. Pat. No. 3,035,671. Another prior art device is generally in the form of a small step ladder, the device being foldable for storage. This device is disclosed in U.S. Pat. No. 4,648,593. More recent apparatus includes an elongated platform having integral blocks under each end to raise the platform to the height of a step. Additional blocks are selectively receivable under the existing blocks to raise the platform further as may be desired.

Thus, all of the prior art exercising steps tend to be unwieldy to manipulate, and very limiting in exercises that can be performed with the devices.

SUMMARY OF THE INVENTION

This invention relates generally to exercise apparatus, and is more particularly concerned with an adjustable, portable step for use in aerobic exercise.

The present invention provides a step having at least one predetermined height, and having the same dimensions in length and width. Height adjusting means is self-contained so the user can select the desired height without the addition or subtraction of other members. Because the length and width are the same, the exercise can be performed without regard for the particular direction the device is approached; and, one can change directions during the exercise without difficulty.

In the preferred embodiment of the invention, the device is circular, so all lateral dimensions are equal. The step includes a base member to be supported on the floor, and a platform member selectively adjustable with respect to the base member. Cooperative tongues and grooves support the platform with respect to the base, and selectively vary the height of the platform with respect to the floor.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
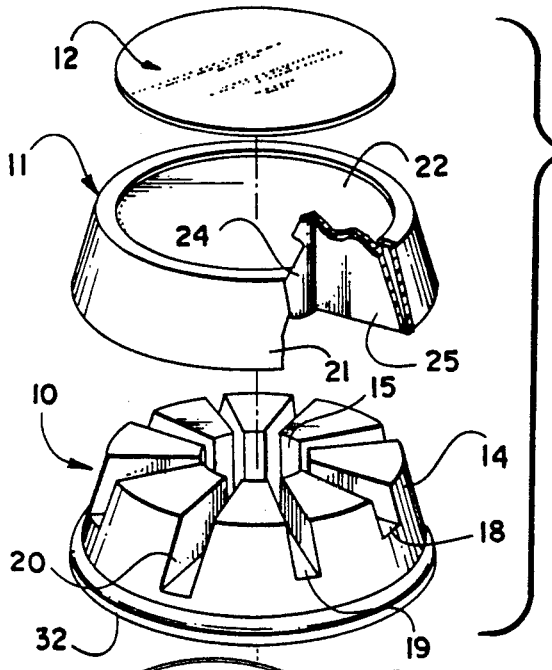
FIG. 1 is an exploded view, partially broken away, showing an exercising step made in accordance with the present invention.

Referring now more particularly to the drawings, and to that embodiment of the invention here presented by way of illustration, the device shown in FIG. 1 of the drawings includes a base member generally designated at 10, a platform member generally designated at 11, and a platform mat generally designated at 12. It will be seen that the base member 10 is generally circular in plan view and includes a body 14 having a central, axial opening 15. The body 14 is therefore annular, and defines a plurality of grooves designated at 18, 19 and 20. As will be better understood hereinafter, there are three of the grooves 18, three of the grooves 19 and three of the grooves 20.

The platform member 11 includes a skirt 21 surrounding an upper platform 22. Centrally of the platform member 11, there is an alignment member 24 concentric with the skirt 21. Extending radially between the alignment member 24 and the skirt 21 there is the plurality of tongues 25. These tongues 25 will be discussed in more detail hereinafter.

It will be seen that the upper platform 22 is slightly recessed below the upper edge of the skirt 21. The recessed area receives the platform mat 12. It is contemplated that the mat 12 will be secured to the support platform 22 by any known means. One might utilize an adhesive, or the mat may be thermally welded or sealed to the platform member 11, and of course various mechanical fasteners might be used if desired.

With the above description in mind, it should be understood generally that the platform member 11 is received over the base member 10. The tongues 25 are received in a selected group of the grooves 18, 19 or 20. All of the tongues 25 are of the same length, while the grooves 18, 19 and 20 are of different depths. The result is, depending on which group of grooves is selected, the height of the platform member 11 will be varied. The alignment member 24 will be received in the opening 15 to assist in maintaining proper alignment of the base 10 and platform 11.

Figure 2A:
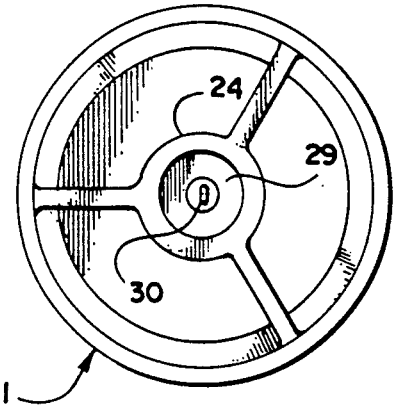
FIG. 2A is a bottom plan view of the platform member illustrated in FIG. 1.
Figure 2B:
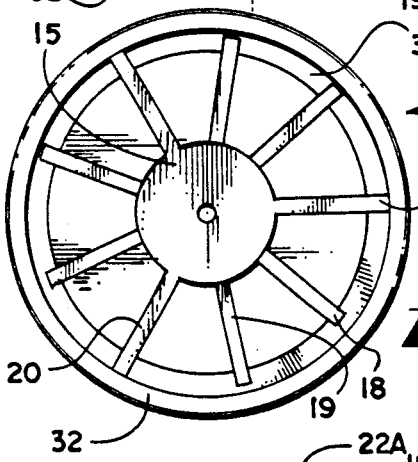
FIG. 2B is a top plan view of the base member illustrated in FIG. 1; and, FIG. 3 is a diametrical cross-sectional view taken through an exercising step of the type illustrated in FIG. 1.

Attention is next directed to FIGS. 2A and 2B of the drawings. FIG. 2A is a bottom plan view of the platform member 11, and FIG. 2B is a top plan view of the base member 10. Thus, the various means for interlocking the base member 10 and the platform member 11 are shown in their true shapes.

In FIG. 2A it will be seen that the alignment member 24 is generally cylindrical, and has three of the tongues 25 extending radially therefrom and merging with the skirt 21. At the bottom of the opening 29 there is a screw eye 30 which will be discussed hereinbelow.

In FIG. 2B it will be noted that the three grooves, e.g., 20, are equally spaced, radiating from the central opening 15. Because of this arrangement, it will be understood that the three tongues 25 which are also equally spaced can be received within the three grooves 20. Similarly, the three tongues 25 may be received within the three grooves 18. Since the three grooves 18 are not as deep as the three grooves 20, the platform member 11 will be higher from the supporting surface than when the tongues 25 are received in the grooves 20. Thus, simply by raising the platform member 11 with respect to the base member 10, and rotating the platform member 11 through 40°, the height of the exercising step can be varied.

To raise the platform 11 with respect to the base 10, it will be recognized that the feet can engage the bead 32 of the base member 10 to hold the base 10. Meanwhile, the fingers can grip the skirt 21 in order to lift the platform member 11, then rotate the platform member 11 to the necessary extent to engage a different set of grooves 18, 19 or 20. It will be obvious, however, that various other lifting means may be provided for the platform member 11. Finger holes may be provided in the upper platform 22, handles may be provided at the upper edge of the platform member 11, and other arrangements may be used as desired.

Figure 3:
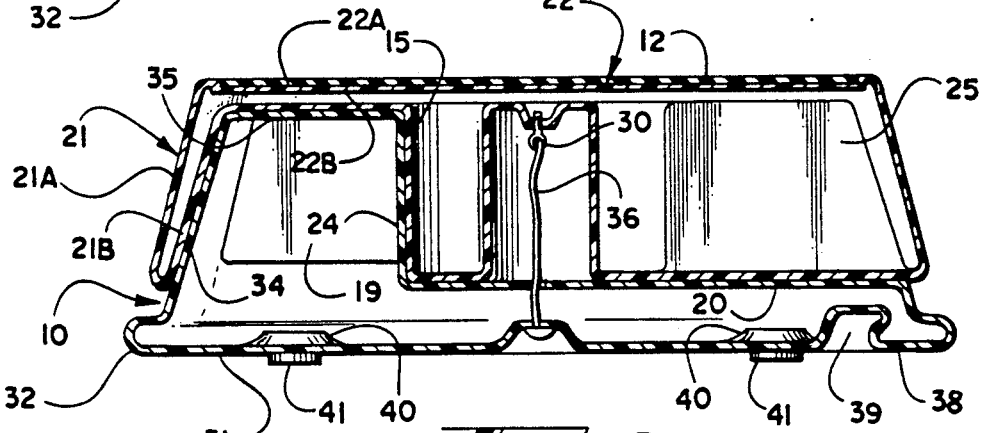

Attention is now directed to FIG. 3 of the drawings which shows the exercising step of the present invention assembled, and the platform member 11 in its lowest position, which is to say the tongues 25 are received within the grooves 20. FIG. 3 is a diametrical cross-sectional view, and illustrates one manner of construction of the device of the present invention.

It will be seen that the skirt 21 as shown in FIG. 3 is a double walled skirt having an air space between the two walls 21A and 21B. Similarly, the upper platform 22 has a double wall and a space between the two walls 22A and 22B. Only the inner wall 22B forms the alignment member 24. The outer wall 22A extends straight across to provide an uninterrupted upper surface.

On the left side of FIG. 3, the cross-section is taken through the body 14, so the body 14 is shown with the platform member supported thereon. In the background, the formation of a groove 19 is shown. On the right side of FIG. 3, the cross-section is taken through one of the tongues 25, so the tongue 25 can be seen resting in the groove 20.

With attention to the base member 10 in FIG. 3, the bottom plate 31 of the base member 10 is generally flat. The base member includes an edge bead 32, leading to a side wall 34. The top 35 is then integrally formed with the side wall 34, and the axial opening 15.

Looking at the structure of the base member 10 and the platform member 11, it will be understood by those skilled in the art that the members may be blow molded. Many different polymers may be used, such as a polyolefin, or perhaps a glass filled polycarbonate. More sophisticated resins may be used, but the cost would be higher, and the better resins should not be required for a good quality product in accordance with the present invention. Further, those skilled in the art will readily recognize that the device may be made of wood for a very nice but expensive version, and may be made of aluminum or other metals if desired.

In FIG. 3, there is an elastic member 36 fixed to the screw eye 30 and to the bottom 31. While use of the elastic member 36 is optional, it holds the base member 10 and platform member 11 together. The member 36 will stretch sufficiently to allow the platform member 11 to be raised enough to rotate the platform member for a height adjustment, but the two pieces 10 and 11 will not completely separate.

It should be noticed that the base member 10 is provided with a handle 38. As here shown, the handle 38 comprises a molded portion of the bottom plate 31. The bottom plate 31 is deformed upwardly, allowing a person's fingers to enter the space 39. Thus, the fingers can wrap around the handle 38 and enter the space 39. An easy grip is thereby provided; and, while only one handle is here shown, it will be understood that similar handles can easily be provided all around the base 10 as may be desired.

Finally, there are depressions 40 in the bottom plate 31 for receiving feet 41. The feet 41 are preferably non-skid material such as rubber or the like to prevent inadvertent lateral motion of the step.

With the above description in mind, it will be understood that the step of the present invention is convenient and versatile. For simple stepping exercise the device is easily available and adjustable in height. For very young people and very old people, the device may be small, allowing a low step, with some increase in height for more strenuousness. For people between the extremes, the device may have reasonable height at its lowest, and be capable of being raised for an even more strenuous exercise.

Regardless of the height selected, it will be understood that many exercises can be done with the step. In modern aerobics, part of the effort is to make the exercise fun for the participants. With small children, there is an effort to make the children think of the exercise as a dance or a game in order to hold their interest. With adults, there is an effort to make the exercise simulate dancing, or otherwise try to make the exercise fun, so many different steps and techniques are utilized. The prior art elongated steps, or benches, are very limiting in the dance steps, or approaches to the device. The present invention, however, is the same from any direction of approach and allows great variation in the activities.

The device of the present invention can be made in almost any size to suit the age and agility of the person using the device. It is contemplated, however, that a general purpose device for the average age-range may have a diameter of about two feet, with heights of around 8, 9½, and 11 inches.

It will of course be understood by those skilled in the art that the particular embodiment of the invention herein disclosed is by way of illustration only, and is meant to be in no way restrictive; therefore, numerous changes and modifications may be made, and the full use of equivalents resorted to, without departing from the spirit or scope of the invention as outlined in the appended claims.

I claim:

1. A step for use in exercising, said step including a platform member and a base member for supporting said platform member, said platform member including an upper circular platform onto which one can step for purposes of exercising, a plurality of tongues extending down from said upper platform, said tongues extending radially of said circular upper platform and being equiangularly spaced around said upper platform, and a skirt surrounding said upper platform, and said plurality of tongues said base member including a body defining a plurality of grooves therein, said grooves being arranged selectively to receive said plurality of tongues, said body of said base member being receivable within said skirt when said plurality of tongues is received within some of said plurality of grooves, said plurality of grooves comprising a first plurality of grooves of a first depth, and a second plurality of grooves of a second depth, said plurality of tongues being simultaneously receivable selectively in said first plurality of grooves and said second plurality of grooves for placing said upper circular platform selectively at a first height and a second height.

2. A step as claimed in claim 1, and including alignment means for maintaining said platform member in alignment with said base member.

3. A step as claimed in claim 2, said body defining a central opening therein, said platform member including an alignment member concentrically thereof, said alignment member being receivable within said central opening to constitute said alignment means.

4. A step as claimed in claim 3, and further including elastic means for attaching said platform member to said base member, said elastic means allowing limited separation of said platform member from said base member.

5. A step as claimed in claim 4, said base member defining a finger space in the bottom thereof for providing a handle for carrying said step.

6. A step as claimed in claim 5, wherein said plurality of grooves further includes a third plurality of grooves of a third depth for placing said upper circular platform at a third height.

7. A step as claimed in claim 1, wherein said plurality of tongues are of substantially equal lengths.

* * * * *